US005529094A

United States Patent [19]

Nishimura et al.

[11] Patent Number: 5,529,094

[45] Date of Patent: Jun. 25, 1996

[54] METHOD AND APPARATUS FOR MANUFACTURING CARBON FIBER WOVEN FABRIC BY WATER-JET LOOM

[75] Inventors: Akira Nishimura, Ehime; Kiyoshi Homma, Ohmihachiman; Seishirou Ichikawa, Otsu, all of Japan

[73] Assignee: Toray Industries, Inc., Japan

[21] Appl. No.: 343,571

[22] PCT Filed: Mar. 29, 1994

[86] PCT No.: PCT/JP94/00510

§ 371 Date: Nov. 29, 1994

§ 102(e) Date: Nov. 29, 1994

[87] PCT Pub. No.: WO94/23104

PCT Pub. Date: Oct. 13, 1994

[30] Foreign Application Priority Data

Apr. 1, 1993 [JP] Japan ..... 5-100323

[51] Int. Cl.[6] ..... D03D 23/00; D03D 47/32

[52] U.S. Cl. ..... 139/435.1; 139/450; 139/452; 139/435.4

[58] Field of Search ..... 139/435.4, 452, 139/450, 435.1, 55.1, 92

[56] References Cited

U.S. PATENT DOCUMENTS

| | | | |
|---|---|---|---|
| 4,074,727 | 2/1978 | Kwok et al. | 139/435.4 |
| 4,134,435 | 1/1979 | Cornellier | 139/435.4 |
| 4,270,578 | 6/1981 | Nishiyama | 139/92 |
| 5,070,913 | 12/1991 | Palmer | 139/55.1 |
| 5,119,863 | 6/1992 | Okesaku et al. | 139/435.4 |

FOREIGN PATENT DOCUMENTS

| | | |
|---|---|---|
| 60-151341 | 1/1984 | Japan . |
| 60-199951 | 3/1984 | Japan . |

*Primary Examiner*—Andy Falik

*Attorney, Agent, or Firm*—Austin R. Miller

[57] ABSTRACT

A method and apparatus is provided for manufacturing a carbon fiber woven fabric by opening and closing a warp sheet formed of carbon fiber warps and by injecting wefts made of carbon fibers by water-jet into the warp sheet when the warp sheet is open. The accumulation of fluffs generated by abrasion between the weft and various guides is reduced by interrupting dispersion of water injected from the nozzle onto the weft as the weft travels from a bobbin to the nozzle, by sucking fluffs from the weft, and/or by causing contact between the weft and fluffs on the surface of the nozzle by loosening the weft, thereby making it possible to conduct a high-speed continuous operation.

16 Claims, 5 Drawing Sheets cloth fell A

METHOD AND APPARATUS FOR MANUFACTURING CARBON FIBER WOVEN FABRIC BY WATER-JET LOOM

BACKGROUND OF THE INVENTION

1. Field of the Invention

The present invention relates to a method and an apparatus for manufacturing a carbon fiber woven fabric using a water-jet loom.

2. Description of the Prior Art

Carbon fiber woven fabrics are broadly used as intermediate base materials for molding carbon fiber reinforced plastics (CFRP). Although CFRP is used for goods for sports and leisure, materials for aircraft, etc. because it is excellent in mechanical properties such as specific strength and specific elastic modulus, cost reduction of intermediate base materials such as woven fabrics is an important subject as well as cost reduction of carbon fiber itself in order to further enlarge the application for CFRP.

Because carbon fiber is fragile and high in stiffness, essentially it is easily woven. Besides, because carbon fiber has a small diameter of a single fiber, that is, a small single fiber diameter, of 5 to 15 μm as compared with that of a usual natural fiber or synthetic fiber and the tensile elongation at break thereof is also small to be in the range of 1.5 to 2.5% and further the knot strength thereof is low, generation of fluffs in a weaving process is inevitable. Namely, it is a difficult fiber to weave From such points, for example, as described in JP-A-SHO 63-315638, it is woven while paying attention to generation of fluffs and yarn cutting, using a shuttle loom or a rapier loom.

In a shuttle loom or a rapier loom, however, the driving speed of wefts is suppressed to a low range of about 80 to 200 picks/min by the weaving mechanism, and there is a problem that the efficiency is reduced.

On the other hand, as a weaving machine capable of performing a high-speed weaving, a water-jet loom, wherein a weft to be flown or picked is placed on water with a high pressure injected from a nozzle (water-jet flow) is known. However, as a result of weaving using such a water-jet loom and using a carbon fiber yarn as the weft, the weaving could be performed with no trouble for a certain period of time, but during weaving, the nozzle may become clogged with fluffs generated on the weft by abrasion between the weft and various guides and miss the weft and therefore, an operator may be forced to stop the machine.

Further, with respect to the warp, warps comprising carbon fiber yarns are abraded violently with healds and reed dents caused by the vertical motion of the healds and the oscillating motion of the reed, and also fluffs are generated. If fluffs are generated, not only the quality of the woven fabric is reduced, but also fluffs sticking on the reed dents and the warps are dispersed in the width direction of the woven fabric by being removed therefrom by the weft and being conveyed together with the weft when the weft is flown, thereby causing a defect of the woven fabric. Furthermore, the warps are easily cut when fluffs are accumulated on the reed dents, and because the accumulated fluffs must be removed every time after the weaving has been performed at a length of about 100 m in order to prevent this problem, there is also a problem that the efficiency is bad.

From the above-described problems, in the manufacture of a carbon fiber woven fabric by the conventional water-jet loom, although the weaving speed is high, the frequency of machine shut down is high, and the efficiency as a whole is not good.

SUMMARY OF THE INVENTION

An object of the present invention is to solve the problems such as clogging of a nozzle for flying a weft comprising carbon fibers due to fluffs and to provide a method and apparatus for manufacturing a carbon fiber woven fabric by a water-jet loom enabling a high-speed continuous operation.

Another object of the present invention is to provide a method and apparatus for manufacturing a carbon fiber woven fabric by water-jet loom capable of preventing the above-described generation of fluffs on warps and warp cutting and enabling a high-speed continuous operation.

DESCRIPTION OF THE INVENTION

Figure 1:
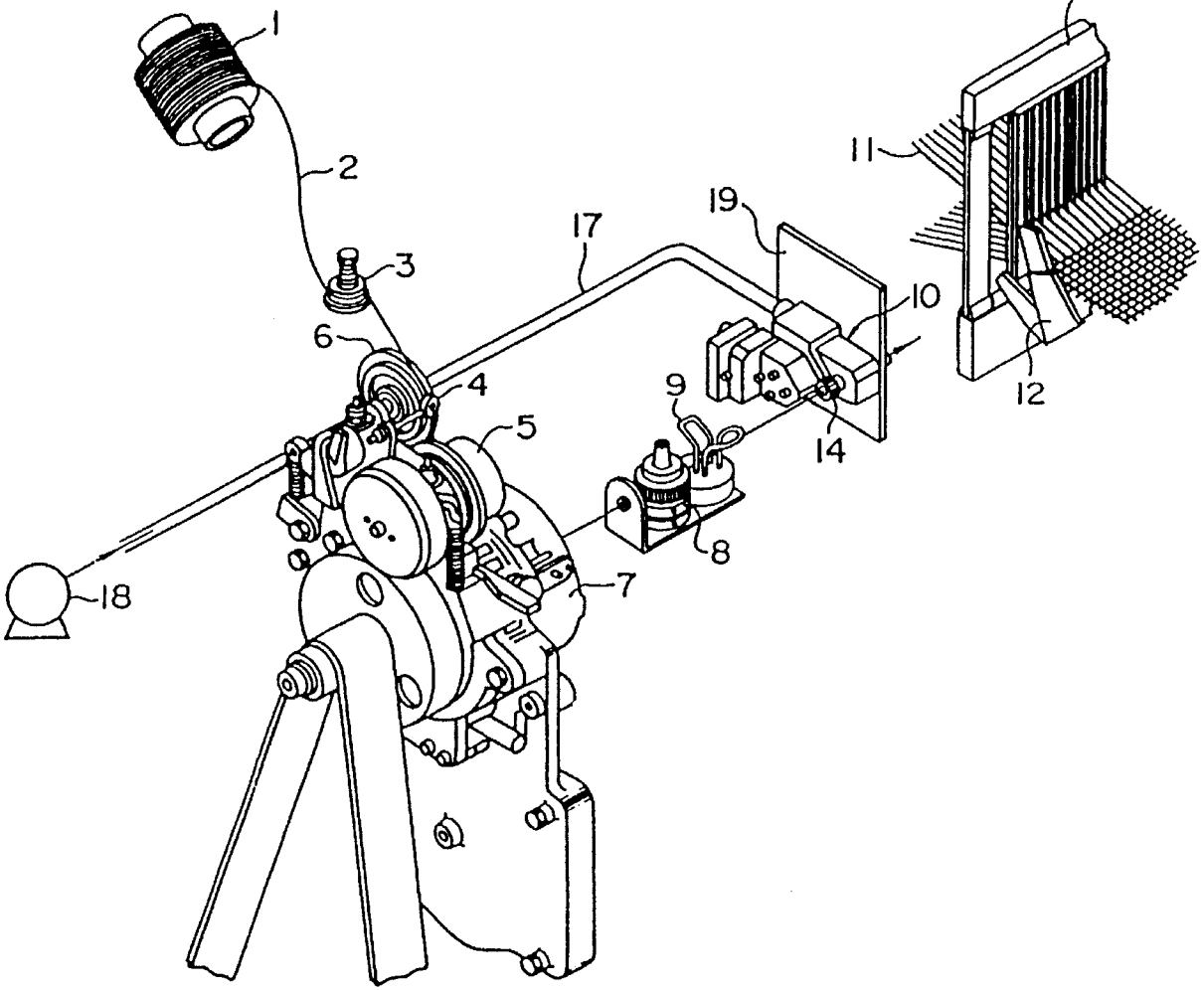
FIG. 1 is a schematic perspective view of a main portion of an apparatus for manufacturing a carbon fiber woven fabric by water-jet loom according to an embodiment of the present invention.

To accomplish the above objects, a method for manufacturing a carbon fiber woven fabric using a water-jet loom according to the present invention, by moving a warp sheet to open and close the warp sheet, storing a weft including carbon fibers in a storage area at an amount corresponding to one pick and placing the weft on water injected from a nozzle of the water-jet loom to be driven into the warp sheet when the warp sheet is opened, is characterized in that the weft is driven while interrupting dispersion of water injected from the nozzle on a weft running path extending from a bobbin around which the weft is wound to a needle entrance portion of the nozzle. Hereinafter, this is called "a first invention".

Another method for manufacturing a carbon fiber woven fabric using a water-jet loom according to the present invention, by moving a warp sheet to open and close the warp sheet, storing a weft including carbon fibers in a storage area at an amount corresponding to one pick and placing the weft on water injected from a nozzle of the water-jet loom to be driven into the warp sheet when the warp sheet is opened, is characterized in that the weft is driven while sucking fluffs sticking on the weft by air suction at least at a position between the storage area and a needle entrance portion of the nozzle in a weft running path extending from a bobbin around which the weft is wound to the needle entrance portion of the nozzle. Hereinafter, this is called "a second invention".

A further method for manufacturing a carbon fiber woven fabric using a water-jet loom according to the present invention, by moving a warp sheet to open and close the warp sheet, storing a weft including carbon fibers in a storage area at an amount corresponding to one pick and placing the weft on water injected from a nozzle of the water-jet loom to be driven into the warp sheet when the warp sheet is opened, is characterized in that a weft is brought into contact with fluffs sticking on the surface of a tube wall of a needle entrance portion of the nozzle by being loosened so as to be extended along the surface of the tube wall-during the time when a succeeding weft with an amount corresponding to one pick is stored in the storage area after a weft with an amount corresponding to one pick has been driven, and the fluffs are driven together with the succeeding weft at the time when the succeeding weft is driven. Hereinafter, this is called "a third invention".

A still further method for manufacturing a carbon fiber woven fabric using a water-jet loom according to the present invention, by moving a warp sheet to open and close the warp sheet, storing a weft including carbon fibers in a storage area at an amount corresponding to one pick and placing the weft on water injected from a nozzle of the water-jet loom to be driven into the warp sheet when the warp sheet is opened, is characterized in that:

(a) dispersion of water injected from the nozzle on a weft running path extending from a bobbin around which the weft is wound to a needle entrance portion of the nozzle is interrupted; and (b) while fluffs sticking on the weft are sucked by air suction at least at a position between the storage area and the needle entrance portion of the nozzle in the weft running path extending from the bobbin around which the weft is wound to the needle entrance portion of the nozzle;

(c) a weft is brought into contact with fluffs sticking on the surface of a tube wall of the needle entrance portion of the nozzle by being loosened so as to be extended along the surface of the tube wall during the time when a succeeding weft with an amount corresponding to one pick is stored in the storage area after a weft with an amount corresponding to one pick has been driven, and the fluffs having been sticking on the surface of the tube wall are sucked by the air suction as well as fluffs which have not been sucked are driven together with the succeeding weft at the time when the succeeding weft is driven. Hereinafter, this is called "a fourth invention".

A still further method for manufacturing a carbon fiber woven fabric using a water-jet loom according to the present invention, by moving a warp sheet to open and close the warp sheet and placing a weft on water injected from a nozzle of the water-jet loom to be driven into the warp sheet when the warp sheet is opened, is characterized in that respective healds guiding respective warps are fixed in position in a direction of warp arrangement, and the respective warps sent from the respective healds are passed through respective reed mails formed between reed dents at nearly central positions of the respective reed mails in the direction of warp arrangement. Hereinafter, this is called "a fifth invention".

In the above-described first to fifth inventions, if water is applied to the warp sheet being moved to open and close, generation of fluffs on the warps can be further suppressed.

An apparatus for manufacturing a carbon fiber woven fabric using a water-jet loom according to the present invention, by moving a warp sheet to open and close the warp sheet, storing a weft including carbon fibers in a storage area at an amount corresponding to one pick and placing the weft on water injected from a nozzle of the water-jet loom to be driven into the warp sheet when the warp sheet is opened, is characterized in that means for interrupting dispersion of injected water on a weft running path extending from a bobbin around which the weft is wound to a needle entrance portion of the nozzle is provided on a water-injection side of the water-jet loom. Hereinafter, this is called "a sixth invention".

Another apparatus for manufacturing a carbon fiber woven fabric using a water-jet loom according to the present invention, by moving a warp sheet to open and close the warp sheet, storing a weft including carbon fibers in a storage area at an amount corresponding to one pick and placing the weft on water injected from a nozzle of the water-jet loom to be driven into the warp sheet when the warp sheet is opened, is characterized in that air suction means for sucking fluffs sticking on the weft is provided at least at a position between the storage area and a needle entrance portion of the nozzle in a weft running path extending from a bobbin around which the weft is wound to the needle entrance portion of the nozzle. Hereinafter, this is called "a seventh invention".

A further apparatus for manufacturing a carbon fiber woven fabric using a water-jet loom according to the present invention, by moving a warp sheet to open and close the warp sheet, storing a weft including carbon fibers in a storage area at an amount corresponding to one pick and placing the weft on water injected from a nozzle of the water-jet loom to be driven into the warp sheet when the warp sheet is opened, is characterized in that means for loosening a weft so as to be extended along the surface of a tube wall of a needle entrance portion of the nozzle during the time when a succeeding weft with an amount corresponding to one pick is stored in the storage area after a weft with an amount corresponding to one pick has been driven is provided. Hereinafter, this is called "an eighth invention".

A still further apparatus for manufacturing a carbon fiber woven fabric using a water-jet loom according to the present invention, by moving a warp sheet to open and close the warp sheet, storing a weft including carbon fibers in a storage area at an amount corresponding to one pick and placing the weft on water injected from a nozzle of the water-jet loom to be driven into the warp sheet when the warp sheet is opened, is characterized in that:

(a) means for interrupting dispersion of injected water on a weft running path extending from a bobbin around which the weft is wound to a needle entrance portion of the nozzle is provided on a water-injection side of the water-jet loom; and (b) air suction means for sucking fluffs sticking on the weft at least at a position between the storage area and the needle entrance portion of the nozzle in the weft running path extending from the bobbin around which the weft is wound to the needle entrance portion of the nozzle as well as means for loosening a weft so as to be extended along the surface of a tube wall of the needle entrance portion of the nozzle during the time when a succeeding weft with an amount corresponding to one pick is stored in the storage area after a weft with an amount corresponding to one pick has been driven is provided. Hereinafter, this is called "a ninth invention".

A still further apparatus for manufacturing a carbon fiber woven fabric using a water-jet loom according to the present invention, by moving a warp sheet to open and close the warp sheet and placing a weft on water injected from a nozzle of the water-jet loom to be driven into the warp sheet when the warp sheet is opened, is characterized in that respective healds guiding respective warps are fixed in position in a direction of warp arrangement so that the respective warps sent from the respective healds are passed through respective reed mails formed between reed dents at nearly central positions of the respective reed mails in the direction of warp arrangement. Hereinafter, this is called "a tenth invention".

In the above-described sixth to tenth inventions, if means for applying water to the warp sheet being moved to open and close is provided, generation of fluffs on the warps can be further suppressed.

In the above-described first to fourth and sixth to ninth inventions, a carbon fiber yarn is used at least as the weft. The warp may be the same carbon fiber yarn as the weft, or may be a high-strength and high-elastic modulus reinforcing fiber yarn such as glass fiber yarn or polyaramide fiber yarn, or synthetic fiber yarn such as polyamide fiber yarn, polyester fiber yarn, vinyl on fiber yarn, polyethylene fiber yarn, PEEK (polyetheretherketone) fiber yarn, PPS (polyphenylene sulfide) fiber yarn, ABS fiber yarn or polypropylene fiber yarn. The carbon fiber yarn may be a multifilament yarn, or may be a spun yarn.

In the fifth and tenth inventions, a carbon fiber yarn is used at least as the warp. The weft may be the same carbon fiber yarn as the weft, or may be a high-strength and high-elastic modulus reinforcing fiber yarn such as glass fiber yarn or polyaramide fiber yarn, or synthetic fiber yarn such as polyamide fiber yarn, polyester fiber yarn, vinylon fiber yarn, polyethylene fiber yarn, PEEK fiber yarn, PPS fiber yarn, ABS fiber yarn or polypropylene fiber yarn. The carbon fiber yarn may be a multifilament yarn, or may be a spun yarn.

In a case where the carbon fiber yarn is a multifilament yarn, the single fiber diameter thereof is preferably in the range of about 5 to 13 μm. Further, it is preferred that the multifilament yarn has a twist of about 10 to 25 turns/m for further improving the weaving property. In a case where it is a spun yarn, the yarn preferably has a twist of about 100 to 600 turns/m in order to indicate a strength due to friction and tightening. Furthermore, although the carbon fiber yarn may be either PAN (polyacrylonitrile) system or pitch system, in a case where a woven fabric used for molding a CFRP is produced, it is preferred to use a yarn into which a functional group is introduced on the surface by a treatment such as electrolytic oxidation in order to improve the adhesive property with a resin which is a matrix of the CFRP.

In the present invention, however, it is not necessary to constitute the carbon fiber yarn only from carbon fibers. Although the constitution depends upon the application, in a case where the yarn is used for molding a CFRP, it may be a yarn using carbon fibers together with other high-strength and high-elastic modulus fibers such as aramide fibers, glass fibers, silicone carbide fibers or alumina fibers, or may be a yarn using carbon fibers together with synthetic fibers such as PEEK fibers, polyamide fibers, PPS fibers or ABS fibers. In the present invention, such yarns using these reinforcing fibers or synthetic fibers together are included in the concept of the carbon fiber yarn.

The size of the carbon fiber yarn used as the weft is preferably in the range of about 300 d to 4,000 d (d: denier, yarn weight per yarn length of 9,000 m). Since the knot strength of carbon fibers is low, if the size is smaller than 300 d, the weft is likely to be cut when the weft is bent in the storage area or when a clamper is closed. If the size is greater than 4,000 d, because the weight of the weft becomes large and it becomes hard to fly the weft by water injected from the nozzle, the weft being flown is likely to come into contact with the warp sheet being opened to cause a defect in the woven fabric formed. Further, the size of the carbon fiber yarn used as the warp is preferably in the range of about 300 d to 8,000 d.

Further, it is preferred that a sizing agent is provided to the carbon fiber yarn at an amount of about 0.4 to 1.5% weight from the viewpoint of further suppressing the generation of fluffs. Because the carbon fibers have a high stiffness, if the amount of the sizing agent is too much, they become hard. As the sizing agent, a sizing agent of epoxy system is preferred because the woven fabric can be molded into a CFRP directly without post treatment such as degumming after weaving.

DESCRIPTION OF THE PREFERRED EMBODIMENTS

FIG. 1 shows mainly a portion for driving a weft in an apparatus for manufacturing a carbon fiber woven fabric by water-jet loom according to an embodiment of the present invention. Firstly, a yarn path along which a weft passes (a weft running path) will be explained.

A weft 2 made of carbon fibers unwound from a bobbin 1 is passed through a washer type tenser 3 to be provided with a tension. Weft 2 is then passed through a yarn guide 4, introduced into a position between a feed roller 5 which is positively driven and a pressure roller 6, and while nipped by feed roller 5 and pressure roller 6, the length of weft 2 required for one driving, that is, one pick, is determined, and it is introduced into a weft storage drum 7 at a constant speed. Weft 2 sent from weft storage drum 7 reaches a nozzle 14 of a nozzle joint 10 after passing through a clamper 8 and a gate wire 9.

A pipe 17 is connected to nozzle joint 10, and a pump 18 is connected to the pipe 17. Water required for one driving of the weft is determined by the pump 18, and the water is sent to nozzle joint 10 after being. The amount of the water is in the range of about 3 to 6 $cm^3$, and the pressure thereof is in the range of about 12 to 25 $kgf/cm^2$.

Figure 2:
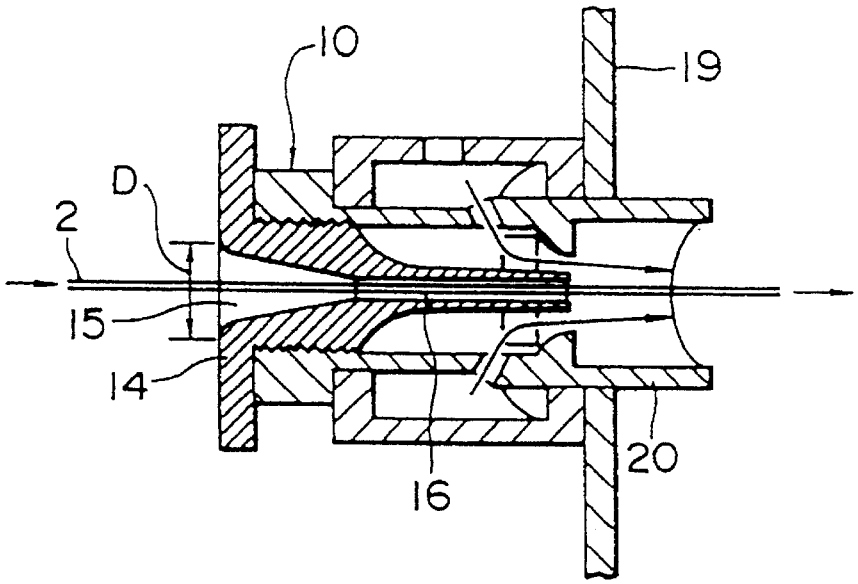
FIG. 2 is a schematic vertical sectional view of a nozzle portion of the apparatus shown in FIG. 1.

Nozzle 14 has a structure as shown in FIG. 2, and weft 2 being passed from a needle entrance portion 15 through the inside of a needle 16 is placed on the water-jet flow due to the pressurized water supplied to nozzle joint 10. The pressurized water supplied to nozzle joint 10 firstly stretches the weft 2 positioned at the tip of needle 16 of nozzle 14. Thereafter, clamper 8 opens, the above-described weft 2 determined in length and stored is placed on the water-jet flow to be conveyed to a position of a warp sheet 11 when the warp sheet 11 opens and a reed 13 begins to retreat. Namely, the weft 2 having been stored is driven. After weft 2 is driven, reed 13 moves forward to move the weft 2 up to the cloth fell (root portion of the opened warp sheet 11), the weft 2 is cut by a cutter 12 when the warp sheet 11 is closed, and further, clamper 8 is closed and the supply of the weft 2 is stopped. Then, a succeeding weft 2 required for the next driving is accumulated in weft storage drum 7, and after it reaches a required yarn length, the next driving of the weft is started.

Although the above-described apparatus and operation are substantially the same as those in the manufacture of conventional woven fabrics by water-jet loom, if the clogging of a nozzle caused by fluffs, which are generated by a condition that a weft is abraded by various guides and a weft storage drum, could be solved, a high-speed continuous weaving would become possible.

As aforementioned, because carbon fibers are low in knot strength and small in elongation at break and the single fiber diameter thereof is very small as compared with that of usual natural fibers or synthetic fibers, fluffs are easily generated. The fluffs of carbon fibers are generated even in the stage of the production of the carbon fibers, different from the case of synthetic fibers. Therefore, the weft wound on a bobbin originally includes fluffs. Besides, because the speed of the weft in a water-jet loom is high to be in the range of 300 to 1,500 m per one minute, the generation of fluffs due to abrasion with a yarn layer when the weft is unwound from a bobbin, abrasion with a tenser and a yarn guide, abrasion with a weft storage drum when it is nipped between a feed roller and a pressure roller,abrasion with a clamper and gate wire after it has passed the weft storage drum, and others, is inevitable. Such fluffs stick to the weft and move together with the weft, accumulate at a needle entrance portion of a nozzle, and at last it develops to clogging of the nozzle. Fortunately, however, the fluffs generated have a small specific gravity of about 1.75 to 1.90 and a small diameter, and they are like short fibers whose lengths are in the range of several millimeters to several centimeters, and because the elastic modulus of carbon fibers is high, entanglement of single fibers such as that in synthetic fibers is little. Therefore, they can be easily dispersed in the atmosphere.

When observed in detail, the accumulation of fluffs is particularly noticeable on the portions of the clamper and the gate wire. When the amount of fluffs accumulated becomes large, the fluffs move with the driven weft, and they are accumulated on needle entrance portion 15 of nozzle 14 shown in FIG. 2. Although the weft is placed on the water-jet flow and normally driven during the time when the amount of the accumulation is small and the resistance due to the fluffs is small, the amount of the accumulation becomes larger during the time when the driving is repeated and the needle entrance portion 15 is clogged, and at last the driving cannot be performed.

In the conventional water-jet loom, although a water-proof cover is generally provided in order to prevent the dispersion of water injected from a nozzle, a needle entrance portion of the nozzle is always wetted with water because it is located within the dispersion area of water. This increases the accumulation of fluffs on the needle entrance portion 15.

Figure 3:
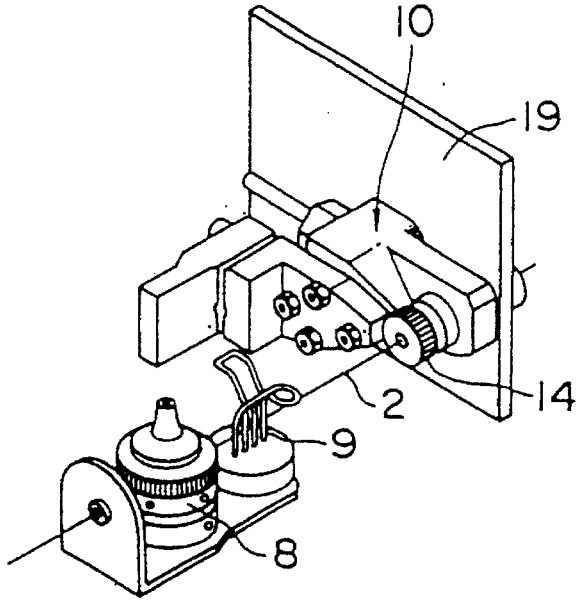
FIG. 3 is a schematic perspective view of a main portion of the apparatus shown in FIG. 1.

Accordingly, in the present invention, as shown in FIG. 3, a water-proof cover 19 is provided on a water-injection side of nozzle 14 so that needle entrance portion 15 of the nozzle 14 is out of the dispersion area of the injected water. Specifically the water-proof cover 19 is attached to the tip portion of a nozzle holder 20 (FIG. 2) and the needle entrance portion 15 is out of the dispersion area of the injected water. Further, besides the needle entrance portion 15, water is prevented from being dispersed on a weft running path from bobbin 1 to the needle entrance portion 15 of nozzle 14 by this water-proof cover 19.

By preventing water from being dispersed on the weft running path from bobbin 1 to needle entrance portion 15 of nozzle 14, the clogging of fluffs up to the needle entrance portion 15 of the nozzle 14 can be solved, thereby making it possible to effect a continuous operation of driving weft 2. In practice, fluffs being accumulated on the clamper and the gate wire become less, and the accumulation of fluffs on needle entrance portion 15 also becomes less. The reason is understood that sticking of fluffs due to water on the weft running path including needle entrance portion 15 is prevented by interruption of the water dispersion and the fluffs are dispersed in the atmosphere.

Figure 4:
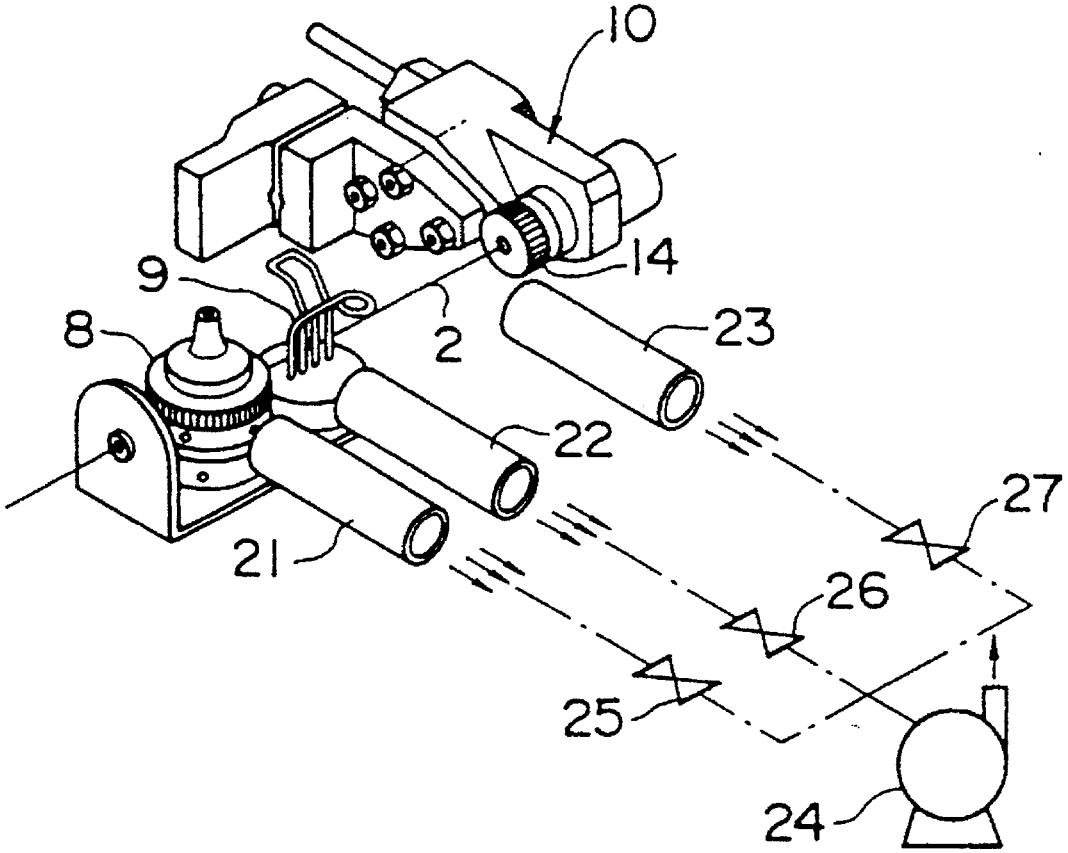
FIG. 4 is a schematic perspective view of a portion adding an air suction pipe to the portion shown in FIG. 3.

Because fluffs are likely to be dispersed in the atmosphere, the fluffs involved in the bobbin and the fluffs generated thereafter also can be sucked (air suction) by suction pipes 21, 22 and 23 provided on the portions of clamper 8, gate wire 9 and needle entrance portion 15, as shown in FIG. 4. This suction is performed using a blower 24, and the suction abilities of the respective suction pipes 21, 22 and 23 are set by valves 25, 26 and 27. Respective blowers separate from each other may be provided for the respective suction pipes 21, 22 and 23.

In the air suction, the suction ability of a single suction pipe is preferably set in the range of about 0.1 to 2.0 $m^3$/min.

If it is smaller than 0.1 $m^3$/min, there is a fear that fluffs are slightly accumulated on the clamper, the gate wire and the needle entrance portion, and when an operation for a long period of time is performed, the accumulation of fluffs on the needle entrance portion becomes large, thereby causing clogging of the nozzle. If greater than 2.0 $m^3$/min, there occurs a case where the suction force becomes too strong and even a weft is sucked, and the weft comes into contact with a suction port and it is damaged, or the weft comes off from the nozzle, thereby making a succeeding driving impossible. Namely, because the movement of a weft is restricted by the closed clamper during the time when the weft required for a succeeding driving is stored after a prior weft has been driven, and on the other hand, the weft cut by a cutter projects from the tip of the nozzle by about 4 to 6 cm and is in a free condition after the prior driving has finished, if the suction force is too strong, the weft 2 comes off from the nozzle. Further, the size of the suction port of the suction pipe is preferably in the range of 50 to 500 $mm^2$ in cross-sectional area. If smaller than 50 $mm^2$, the suction area becomes small, and if greater than 500 $mm^2$, the suction force becomes weak, and in any case, the suction of fluffs becomes insufficient.

Further, in the present invention, in order to prevent the clogging of the nozzle due to fluffs, fluffs sticking to the surface of a tube wall of the needle entrance portion of the nozzle may be removed by providing a vibration to the weft and driving the removed fluffs together with the weft. Such a provision of vibration can be performed utilizing a suction operation with the above-described suction pipes. Namely, while suction is portion 15 of nozzle 14, during the weft 2 having a length corresponding to one pick is stored in weft storage drum 7 after a prior weft has been flown, the weft 2 loosens so as to extend along the surface of the tube wall of the needle entrance portion 15 of the nozzle 14. Then, when water is injected from the nozzle 14, the weft 2 is stretched straightly to be in a tense condition, and fluffs having been sticking to the surface of the tube wall are driven together with the weft 2. Since this operation is repeated during the time of driving wefts, the accumulation of fluffs can be prevented. The repeated of loosening and stretching of the weft is performed simultaneously with suction of fluffs when the suction pipes are used, and it is preferred. However, the vibration may be provided by mechanical means such as a driven cam.

With respect to the degree of the above-described loosening and stretching of the weft, when the diameter of needle entrance portion 15 of nozzle 14 is referred to as "D" (FIG. 2), it is preferred to control the amplitude of the weft in the range of about 0.5 to 1.0 D in the needle entrance portion 15.

Although a method for removing generated fluffs has been explained in the above description, it is important to suppress the generation of fluffs. This is achieved as follows.

Namely, because fluffs are generated also by abrasion between warps caused by the opening and closing motion of warp sheet 11, the generation of fluffs from the warps is prevented by spraying water on the warp sheet 11, and focusing the respective warps with the water or using the water as a lubricant.

Further, in a case where a weft storage drum is used, although depending upon the diameter of the drum and the length of a driven weft, usually the weft is wound on the drum two or three times and it is unwound from the drum associated with the injection of water. The weft supplied to the drum is wound on the drum by a pressurized air blown to the drum. At that time, there is no problem as long as the weft is wound so that the unwinding of the weft from the drum is performed in order from the nozzle side. However, if a relatively heavy weft is wound by the pressurized air, such a winding condition that the weft is unwound in order from the nozzle side cannot always be achieved, and a weft present at a position far away from the nozzle is unwound earlier than a weft wound at a position close to the nozzle while the former is rubbed by the latter, thereby causing generation of fluffs. In such a case, if a drum whose side close to the nozzle has a smaller diameter and whose side far from the nozzle has a greater diameter is used and the weft is wound on the greater-diameter side whose diameter is greater than that of the smaller-diameter side by 5 to 20%, a winding condition in that the weft is unwound in order from the nozzle side can be obtained, and the generation of fluffs can be suppressed.

The woven fabric thus manufactured is wound after being dried by a heater attached to the water-jet loom or by being passed through a hot roller.

EXAMPLE 1

Carbon fiber yarns each having a number of filaments of 3,000, a cross-sectional area of 0.112 $mm^2$ and a twist of 15 turns/m were prepared as warps and set on creels at a number of 385. They were passed through a reed so that the warp density was 3.5 ends/cm. The same carbon fiber yarn as that of the warp was used as a weft, and a carbon fiber woven fabric having a weft density of 3.5 ends/cm and a weave structure of a plain weave was woven under a condition of a water amount of one pick of 4.2 $cm^3$, a water pressure of a water-jet flow of 18 $kgf/cm^2$ and a rotational speed of a water-jet loom, that is, driving picks of the weft per one minute, of 400 picks/min.

In this Example, a water-proof cover was attached to the tip portion of a nozzle holder, the dispersion of water on a weft running path from a bobbin to a needle entrance portion of a nozzle was interrupted and the weft was prevented from being wetted with the water.

When woven at a length of 1,000 m, the frequency of machine stop due to clogging of the nozzle per a weave length of 100 m was 15.3 times.

EXAMPLE 2

In Example 1, suction pipes having an inner diameter of 18 mm were provided at positions corresponding to the positions of a clamper, a gate wire and the needle entrance portion of the nozzle instead of the interruption by the water-proof cover, the suction ability of each suction pipe was set to 1.05 $m^3$/min., and fluffs were sucked.

When woven at a length of 1,000 m, the frequency of machine stop due to clogging of the nozzle per a weave length of 100 m was 13.1 times.

EXAMPLE 3

In Example 1, the weft was loosened and stretched at the needle entrance portion of the nozzle controlling the amplitude to 1.0 D relative to the diameter "D" of the entrance instead of the interruption by the water-proof cover, and the weaving was performed while removing fluffs sticking on the surface of the tube wall of the needle entrance portion.

When woven at a length of 1,000 m, the frequency of machine stop due to clogging of the nozzle per a weave length of 100 m was 13.1 times.

EXAMPLE 4

In Example 1, the suction of fluffs performed in Example 2 and the loosening and stretching of the weft performed in Example 3 were applied together instead of the interruption by the water-proof cover, and weaving was performed.

When woven at a length of 1,000 m, the frequency of machine stop due to clogging of the nozzle per a weave length of 100 m was 2.5 times.

EXAMPLE 5

In Example 1, the suction of fluffs performed in Example 2 and the loosening and stretching of the weft performed in Example 3 were applied together, and weaving was performed.

When woven at a length of 1,000 m, the frequency of machine stop due to clogging of the nozzle per a weave length of 100 m was only 0.3 time.

COMPARATIVE EXAMPLE 1

In Example 1, when weaving was performed after removing the water-proof cover, clogging of the nozzle occurred after weaving at a length of about 0.1 to 1.5 m. The frequency of machine stop per a weave length of 100 m was 82 times.

Although preferred embodiments of water-jet loom enabling a high-speed continuous operation from the viewpoint of weft have been explained above, next, embodiments thereof from the viewpoint of warp will be explained.

Figure 5:
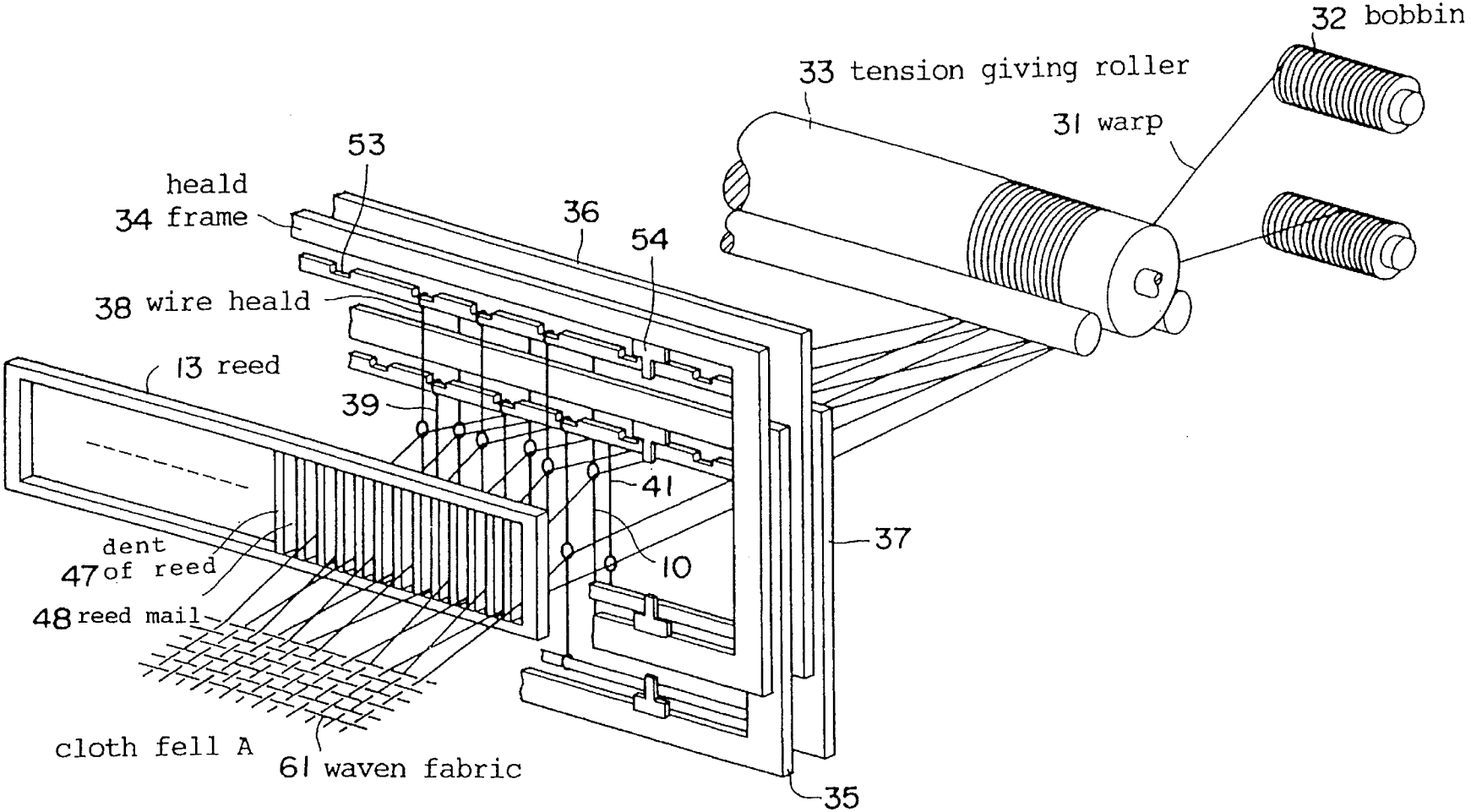
FIG. 5 is a schematic perspective view of a main portion in the apparatus shown in FIG. 1.
Figure 6:
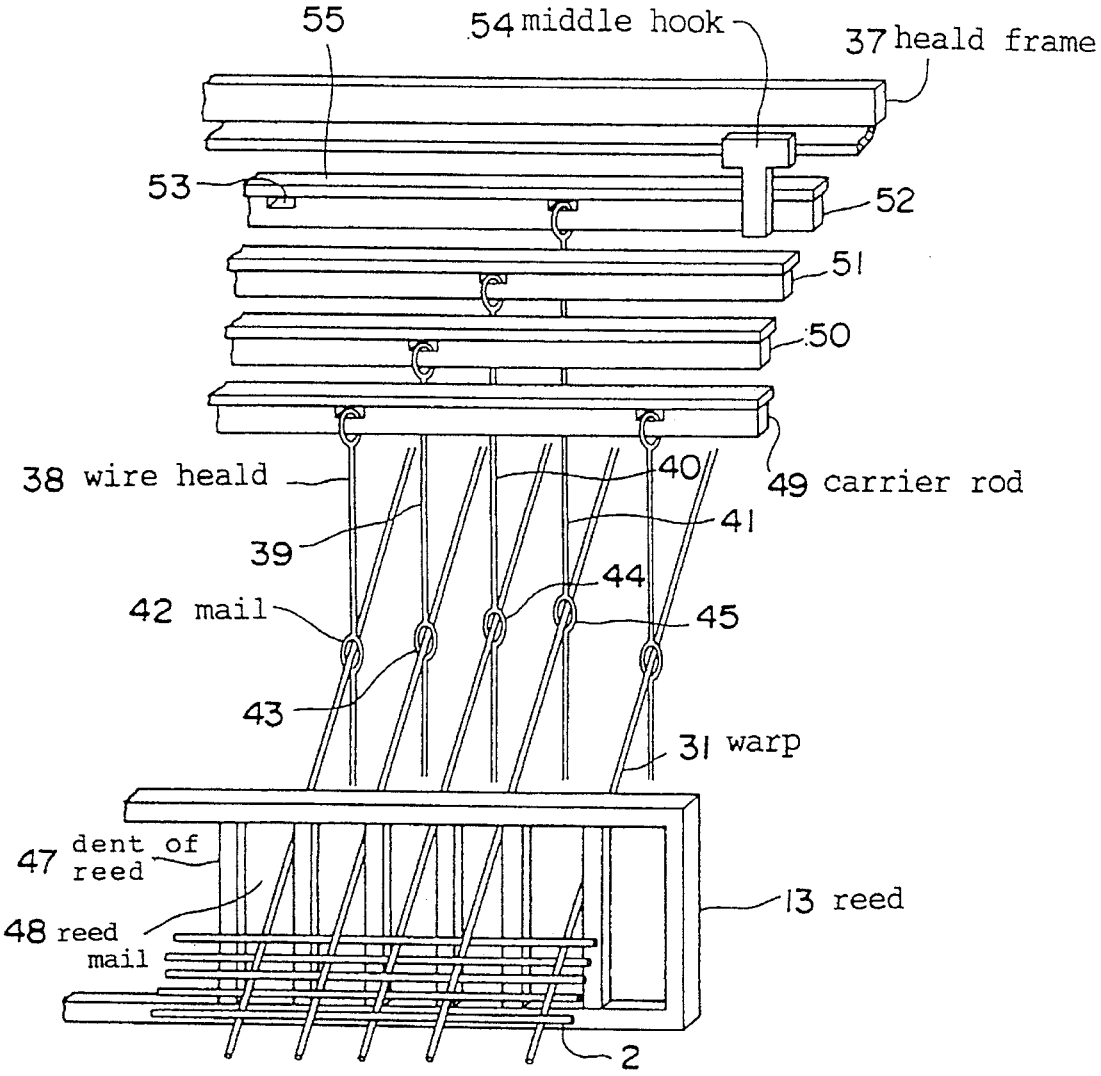
FIG. 6 is a schematic perspective view of the apparatus shown in FIG. 5.

In FIGS. 5 and 6, warps 31 are drawn out from bobbins 32 on creels (not shown). Drawn warps 31 are arranged in parallel to each other, after being passed through a tension giving roller 33, passed through respective mails 42, 43, 44 and 45 of a corresponding number of wire healds 38, 39, 40 and 41 attached to four heald frames, that is, a first heald frame 34, a second heald frame 35, a third heald frame 36 and a fourth heald frame 37, and further passed through reed mails 48 formed between dents 47 of a reed 13 one by one. The opening and closing motion of the warps 31 is provided by synchronizing the vertical motions of a pair of the first heald frame 34 and the third heald frame 36 and a pair of the second heald frame 35 and the fourth heald frame 37. Relative to these vertical motions and at a condition that a tension of 0.01 to 0.03 g/d per one warp is applied, a weft is placed on a water-jet flow to be inserted into the warp sheet, as aforementioned. The inserted weft is then conveyed to a cloth fell by the reed 13, and at that time, the heald frames move to close the warp sheet and a woven fabric 61 is formed. The woven fabric 61 obtained by repeating such a weaving operation is wound after being dried as aforementioned.

Such a process is substantially the same as that of a usual operation using a water-jet loom.

If driving of a weft composed of carbon fibers is performed at a low speed of about 100 to 150 picks/min, weaving is possible by controlling tensions of warps sufficiently and optimizing the surface conditions of guides and rollers. However, if the driving speed is high, particularly at a speed of not lower than 250 picks/min, fluffs are likely to be generated even on the warps composed of carbon fibers, and this causes cutting of the warps.

Accordingly, when the state of generation of fluffs on the warps is observed, although the warps drawn out from creels are almost maintained normal up to the position of the heald frames, many fluffs are generated between that position and the position of the dents of reed.

Further, when the operation state is observed in detail, it is found that the fluffs generated from the warps are not uniform in the width direction of the woven fabric and are concentrated at portions where the intervals between healds attached to carrier rods (FIG. 6) are not uniform. When the warps are passed through four heald frames and the warp sheet is moved to open and close, warps passing through healds of a rear heald frame are abraded by mails of healds of a front heald frame at portions where the intervals between the healds of the front heald frame are not uniform, and fluffs are likely to be generated.

In a carbon fiber woven fabric used for molding of carbon fiber reinforced plastics (CFRP) in order to improve the mechanical properties by suppressing stress concentration due to bending of weaving yarns forming the woven fabric, generally the density of the alignment of the weaving yarns is set small. Therefore, the density of the warps at the time of weaving is also small. Namely, the density of the healds is small. In a case of weaving a synthetic fiber woven fabric, the warp density is large to be in the range of 20 to 50 yarns/cm, the number of used healds is great and the density of the healds is large, and therefore there is no problem. In a case of a carbon fiber woven fabric, however, because the warp density is small to be in the range of about 1 to 15 yarns/cm and the density of the healds is small, that is, the interval of the healds is large, the positions of the healds are greatly moved depending upon the variation of the tension applied to the warps, and it is in a condition where fluffs are likely to be generated to a further extent.

Furthermore, although the warps are passed through reed mails of a reed, because the reed is fixed to a body of a water-jet loom, if the positions of the healds are moved as described in the above, the warps are directed obliquely relative to the mails of the healds, and the warps are abraded with reel dents. Particularly, if the operation is performed at a high speed of not lower than 250 picks/min, the amount of fluffs generated on the warps by this abrasion becomes large.

The present invention solves the above-described problems. Namely, in FIGS. 5 and 6, grooves 53 having regular intervals indicated by warp interval (mm)×number of healds are provided on carrier rods 49, 50, 51 and 52 provided at upper portions in the first heald frame 34, the second heald frame 35, the third heald frame 36 and the fourth heald frame 37, and all the healds are engaged in the grooves 53. The fixing of the carrier rods relative to the heald frames is performed by middle hooks 54 in the vertical direction, and in the horizontal direction, it is performed by setting the grooves 53 so that they are shifted on the respective carrier rods 49, 50, 51 and 52 of the first heald frame 34 to the fourth heald frame 37 with a pitch corresponding to the interval of the warps 31 to arrange the warps 31 with regular intervals and thereafter restricting the movement of the respective healds by holding plates 55. This fixing in the horizontal direction may not always be performed for both the upper and lower carrier rods, and it may be performed for either upper or lower carrier rods.

With respect to the reed 13, the position of the reed 13 or the positions of the respective heald frames are adjusted so that the warps 31 are passed through the reed mails 48 at nearly central positions thereof, and the positions of the heald frames and the reed 13 are fixed. Namely, the angle defined between the surface of the reed and the warps 31 having passed through the respective healds is set at a nearly right angle, and all the warps 31 are set to enter into the center of reed mails 48. Although it is the most preferable that the angle defined between the surface of the reed and the warps having passed through the healds is set at 90 degrees, there is a case where the angle changes slightly depending upon the attachment conditions of the heald frames and the reed. In practice, there is no problem as long as there is an angle in the range of 90 degrees±10 degrees. If the angle is out of this range, the abrasion between the warps and the reed dents becomes remarkable, and the amount of fluffs generated becomes large.

The fixing of the respective healds may be performed by arranging the respective healds on usual carrier rods having no grooves with regular intervals at the pitch of the warps, that is, at the pitch of the reed dents, and then fixing the arranged healds using fixing means such as durable adhesive tape. Namely, the healds arranged at predetermined intervals may be fixed so that they do not move even during operation.

Further, the number of the healds to be used is a number required for forming a structure of a woven fabric. For example, in a case of weave structure of a plain weave, two or four healds, in a case of 5-harness satin weave, five healds, and in a case of 8-harness satin weave, eight healds are used, respectively.

With respect to healds, although healds called "flat healds" are used in a usual water-jet loom, preferably healds having rings are used in the present invention because the generation of fluffs on the warps can be suppressed.

Furthermore, in order to further suppress the generation of fluffs caused by abrasion between the warps caused the opening and closing motion of the warp sheet, it is also preferred that water is sprayed on the warp sheet at a position between the tension giving roller and the healds by means such as a centrifugal humidifier at an amount of about 5 to 20 liters per one hour. The focusing property of the warps is increased by the applied water, and the water operates as a lubricant to further suppress the generation of fluffs. Example 6.

Carbon fiber yarns each having a number of filaments of 3,000, a cross-sectional area of 0.112 $mm^2$ and a twist of 15 turns/m were prepared as warps and set on creels at a number of 550. The warps unwound from the creels were passed through the tension giving roller, and after being passed through the guide roller, they were passed through the mails of the healds attached to the heald frames. Four heald frames were used as the first heald frame, the second heald frame, the third heald frame and the fourth heald frame in order from the side of the cloth fell, and the grooves were provided at an interval of 8 mm, that is, 2 mm (interval of warps)×4 (number of heald frames), on the carrier rods provided on the upper portions of the respective heald frames. The fixing of the carrier rods relative to the heald frames was performed such that the grooves of the respective carrier rods of the first to fourth heald frames were shifted in order by 2 mm and holding plates were provided thereon.

The opening and closing motion of the warp sheet was performed by setting the first and third heald frames as a pair and the second and fourth heald frames as another pair. Further, while spraying water on the warp sheet using a centrifugal humidifier at an amount of 8 liters per one hour, when the warp sheet was opened by the upward movement of the first and third heald frames and the downward movement of the second and fourth heald frames, the weft was placed on the water-jet flow pressurized at a pressure of 18 kgf/cm$^2$ and having a water amount of 4.2 cm$^3$ to be inserted into the warp sheet, the reed was driven, and thereafter, when the warp sheet was opened by the downward movement of the first and third heald frames and the upward movement of the second and fourth heald frames, the weft was driven similarly. Such an operation was repeated, the weaving was performed at a driving speed of wefts of 400 picks/min, and the woven fabric obtained was dried and wound. In the woven fabric obtained, the densities of the warps and the wefts were 5 yarns/cm, respectively, the weight per unit area of the carbon fibers was 200 g/m$^2$, and the width was 110 cm.

Although a small amount of fluffs stuck to the reed as the weaving was continued, it did not affect the quality of the woven fabric up to a length of 1,100 m, and cutting of the warps did not occur. When the length of the weaving was over 1,100 m, because an irregularity of the tension of the warps began to be generated by the fluffs sticking to the reed mails of the reed, the operation was stopped and the fluffs were removed.

COMPARATIVE EXAMPLE 2

A carbon fiber woven fabric was woven in a manner similar to that of Example 6 except that carrier rods without grooves were used.

Fluffs were accumulated in the reed mails of the reed as the weaving was continued, and when the weaving was performed up to a length of about 50 m, reed marks, that is, irregularity of the intervals of the warps, could be observed on the woven fabric being obtained. As the result of the weaving further continued, when the length of the weaving was over 200 m, because an irregularity of the tension of the warps began to be generated by the fluffs sticking to the reed mails of the reed, the operation was stopped and the fluffs were removed. Further, cutting of the warps occurred three times by the time of the removal of the fluffs.

We claim:

1. A method for manufacturing a carbon fiber woven fabric using a water-jet loom having a warp sheet that is movable between an opened position and a closed position as well as wefts each of which includes carbon fibers, said water-jet loom also having a nozzle with a needle entrance portion including a tube wall on the surface of which fluffs tend to be deposited, said method comprising the steps of:

moving said warp sheet between said opened position and said closed position;

storing said weft in a storage area in an amount corresponding to one pick;

placing said weft on water that is injected from said nozzle of said water-jet loom;

driving said weft into said warp sheet when said warp sheet is in said opened position; and interrupting dispersion of said water injected from said nozzle onto said weft as said weft travels from a bobbin around which said weft is wound to said needle entrance portion of said nozzle.

2. A method for manufacturing a carbon fiber woven fabric using a water-jet loom having a warp sheet that is movable between an opened position and a closed position as well as wefts each of which includes carbon fibers, said water-jet loom also having a nozzle with a needle entrance portion at which fluffs tend to be deposited, said method comprising the steps of:

moving said warp sheet between said opened position and said closed position;

storing said weft in a storage area in an amount corresponding to one pick;

placing said weft on water that is injected from said nozzle of said water-jet loom;

driving said weft into said warp sheet when said warp sheet is in said opened position; and sucking said fluffs from said weft by air suction at least at a position between said storage area and said needle entrance portion of said nozzle as said weft travels from a bobbin around which said weft is wound to said needle entrance portion of said nozzle.

3. A method for manufacturing a carbon fiber woven fabric using a water-jet loom having an openable and closable warp sheet and wefts each of which includes carbon fibers, said water-jet loom having a nozzle having a needle entrance portion including a tube wall on the surface of which fluffs tend to be deposited, said method comprising the steps of:

moving said warp sheet between an opened position and a closed position;

storing said weft in a storage area in an amount corresponding to one pick;

placing said weft on water that is injected from said nozzle of said water-jet loom;

driving said weft into said warp sheet when said warp sheet is in said opened position;

causing contact between said weft and said fluffs on the surface of said tube wall by loosening said weft when a succeeding weft is being stored in said storage area after said weft has been driven; and driving said fluffs in a weftwise direction and under the influence of said water and together with said succeeding weft when said succeeding weft is driven toward or into said warp sheet.

4. A method for manufacturing a carbon fiber woven fabric using a water-jet loom having a warp sheet that is movable between an opened position and a closed position as well as wefts each of which includes carbon fibers, said water-jet loom also having a nozzle with a needle entrance portion including a tube wall on the surface of which fluffs tend to be deposited, said method comprising the steps of:

moving said warp sheet between said opened position and said closed position;

storing said weft in a storage area in an amount corresponding to one pick;

placing said weft on water that is injected from said nozzle of said water-jet loom;

driving said weft into said warp sheet when said warp sheet is in said opened position;

interrupting dispersion of said water injected from said nozzle onto said weft as said weft travels from a bobbin around which said weft is wound to said needle entrance portion of said nozzle;

sucking said fluffs from said weft by air suction at least at a position between said storage area and said needle entrance portion of said nozzle as said weft travels from said bobbin to said needle entrance portion of said nozzle;

causing contact between said weft and said fluffs on the surface of said tube wall by loosening said weft when a succeeding weft is being stored in said storage area after said weft has been driven toward or into said warp sheet;

sucking said fluffs from the surface of said tube wall by said air suction; and driving said fluffs which have not been sucked in a weftwise direction and under the influence of said water and together with said succeeding weft when said succeeding weft is driven toward or into said warp sheet.

5. An apparatus for manufacturing a carbon fiber woven fabric comprising:

means for moving a warp sheet to open and close the warp sheet;

means for storing a weft including carbon fibers in a storage area in an amount corresponding to one pick;

a nozzle positioned to form a water jet to drive the weft into the warp sheet when the warp sheet is opened; and means for interrupting dispersion of water injected from the nozzle on a weft running path extending from a bobbin around which the weft is wound to a needle entrance portion of the nozzle, said means for interrupting dispersion of the water being positioned on a water-injection side of said nozzle.

6. An apparatus for manufacturing a carbon fiber woven fabric using a comprising:

means for moving a warp sheet to open and close the warp sheet;

means for storing a weft including carbon fibers in a storage area in an amount corresponding to one pick;

a nozzle positioned to form a water jet to drive the weft into the warp sheet when the warp sheet is opened; and air suction means for sucking fluffs from the weft positioned between said storage area and a needle entrance portion of the nozzle and along at least a portion of a weft running path extending from a bobbin around which the weft is wound to said needle entrance portion of the nozzle.

7. An apparatus for manufacturing a carbon fiber woven fabric comprising:

means for moving a warp sheet to open and close the warp sheet;

means for storing a weft including carbon fibers in a storage area in an amount corresponding to one pick;

a nozzle positioned to form a water jet to drive the weft into the warp sheet when the warp sheet is opened; and means for loosening the weft so as to be extended along the surface of a tube wall of a needle entrance portion of the nozzle during the time when a succeeding weft in an amount corresponding to one pick is stored in the storage area after the weft in an amount corresponding to one pick has been driven.

8. An apparatus for manufacturing a carbon fiber woven fabric comprising:

means for moving a warp sheet to open and close the warp sheet;

means for storing a weft including carbon fibers in a storage area in an amount corresponding to one pick;

a nozzle positioned to form a water jet to drive the weft into the warp sheet when the warp sheet is opened;

means for interrupting dispersion of water injected from the nozzle on a weft running path extending from a bobbin around which the weft is wound to a needle entrance portion of the nozzle, said means for interrupting dispersion of the water being positioned on a water-injection side of said;

air suction means for sucking fluffs from the weft positioned between said storage area and said needle entrance portion of the nozzle along at least a portion of said weft running path extending from said bobbin around which the weft is wound to said needle entrance portion of the nozzle; and means for loosening the weft so as to be extended along the surface of a tube wall of said needle entrance portion of the nozzle during the time when a succeeding weft in an amount corresponding to one pick is stored in the storage area after the weft in an amount corresponding to one pick has been driven.

9. A method for manufacturing a carbon fiber woven fabric using a water-jet loom having a warp sheet that is movable between an opened position and a closed position, a bobbin around which a weft is wound, a storage area for storing said weft in an amount corresponding to at least one pick, and a water nozzle with a needle entrance portion, said method comprising the steps of:

(a) moving said warp sheet between said opened position and said closed position;

(b) advancing said weft along a path from said bobbin to said needle entrance portion of said water nozzle;

(c) injecting water into said water nozzle to form a water jet;

(d) causing said water jet to drive said weft into said warp sheet when said warp sheet is in said opened position; and (e) interrupting dispersion of said water from said water nozzle onto said weft as said weft travels along said path from said bobbin to said needle entrance portion of said water nozzle.

10. A method for manufacturing a carbon fiber woven fabric using a water-jet loom having a warp sheet that is movable between an opened position and a closed position, a bobbin around which a weft is wound, a storage area for storing said weft in an amount corresponding to at least one pick, and a water nozzle with a needle entrance portion, wherein fluffs tend to be deposited on said weft, said method comprising the steps of:

(a) moving said warp sheet between said opened position and said closed position;

(b) advancing said weft along a path from said bobbin to said needle entrance portion of said water nozzle;

(c) injecting water into said water nozzle to form a water jet;

(d) causing said water jet to drive said weft into said warp sheet when said warp sheet is in said opened position; and (e) sucking said fluffs from said weft by providing air suction at a position along a portion of said path from said bobbin to said needle entrance portion of said water nozzle.

11. A method for manufacturing a carbon fiber woven fabric using a water-jet loom having a warp movable between an opened position and a closed position, a bobbin around which a weft is wound, a storage area for storing said weft in an amount corresponding to at least one pick, and a water nozzle with a needle entrance portion including a tube wall on the surface of which fluffs tend to be deposited, said method comprising the steps of:

(a) moving said warp sheet between said opened position and said closed position;

(b) advancing said weft along a path from said bobbin to said needle entrance portion of said water nozzle;

(c) injecting water into said water nozzle to form a water jet;

(d) causing said water jet to drive said weft into said warp sheet when said warp sheet is in said opened position; and (e) causing contact between said weft and said fluffs deposited on the surface of said tube wall by loosening said weft after an amount corresponding to one pick is driven and when a succeeding weft in an amount corresponding to one pick is being stored in said storage area; and (f) driving at least a portion of said fluffs in a weftwise direction and under the influence of said water jet together with said succeeding weft as said succeeding weft is driven toward or into said warp sheet.

12. A method for manufacturing a carbon fiber woven fabric using a water-jet loom having a warp movable between an opened position and a closed position, a bobbin around which a weft is wound, a storage area for storing said weft in an amount corresponding to at least one pick, and a water nozzle with a needle entrance portion including a tube wall on the surface of which fluffs tend to be deposited, said method comprising the steps of:

(a) moving said warp sheet between said opened position and said closed position;

(b) advancing said weft along a path from said bobbin to said needle entrance portion of said water nozzle;

(c) injecting water into said water nozzle to form a water jet;

(d) causing said water jet to drive said weft into said warp sheet when said warp sheet is in said opened position;

(e) sucking a portion of said fluffs from said weft by providing air suction at a position along a portion of said path from said bobbin to said needle entrance portion of said water nozzle;

(f) causing contact between said weft and a portion of said fluffs deposited on the surface of said tube wall by loosening said weft after an amount corresponding to one pick is driven and when a succeeding weft in an amount corresponding to one pick is being stored in said storage area;

(g) sucking a portion of said fluffs from the surface of said tube wall with said air suction; and (h) driving a portion of said fluffs which have not been sucked in a weftwise direction and under the influence of said water jet together with said succeeding weft as said succeeding weft is driven toward or into said warp sheet.

13. A water-jet loom for manufacturing a carbon fiber woven fabric, said water-jet loom comprising:

a bobbin around which a weft is wound;

a storage area positioned to receive said weft from said bobbin in an amount corresponding to one pick;

means for moving a warp sheet between an opened position and a closed position;

a water nozzle positioned to form a water jet to drive said weft into said warp sheet when said warp sheet is in said opened position, said water nozzle having a needle entrance portion positioned to receive said weft from said storage area; and means for interrupting dispersion of water from said water nozzle onto said weft as said weft is advanced along a path from said bobbin to said needle entrance portion of said water nozzle, said means for interrupting dispersion being mounted on a water-injection side of said water nozzle.

14. A water-jet loom for manufacturing a carbon fiber woven fabric, said water-jet loom comprising:

a bobbin around which a weft is wound, wherein fluffs tend to deposited on said weft;

a storage area positioned to receive said weft from said bobbin in an amount corresponding to one pick;

means for moving a warp sheet between an opened position and a closed position;

a water nozzle positioned to form a water jet to drive said weft into said warp sheet when said warp sheet is in said opened position, said water nozzle having a needle entrance portion positioned to receive said weft from said storage area; and air suction means for sucking said fluffs from said weft positioned between said storage area and said needle entrance portion of said water nozzle and along at least a portion of a path of said weft extending from said bobbin to said needle entrance portion.

15. A water-jet loom for manufacturing a carbon fiber woven fabric, said water-jet loom comprising:

a bobbin around which a weft is wound;

a storage area positioned to receive said weft from said bobbin in an amount corresponding to one pick;

means for moving a warp sheet between an opened position and a closed position;

a water nozzle positioned to form a water jet to drive said weft into said warp sheet when said warp sheet is in said opened position, said water nozzle having a needle entrance portion including a tube wall positioned to receive said weft from said storage area, wherein fluffs tend to be deposited on said tube wall; and means for loosening said weft so that it contacts said fluffs on a surface of said tube wall of said needle entrance portion of said water nozzle.

16. A water-jet loom for manufacturing a carbon fiber woven fabric, said water-jet loom comprising:

a bobbin around which a weft is wound, wherein fluffs tend to be deposited on said weft;

a storage area positioned to receive said weft from said bobbin in an amount corresponding to one pick;

means for moving a warp sheet between opened and closed positions;

a water nozzle positioned to drive said weft into said warp sheet when said warp sheet is in said opened position, said water nozzle having a needle entrance portion including a tube wall positioned to receive said weft from said storage area, wherein fluffs tend to be deposited on said tube wall;

means for interrupting dispersion of water from said water nozzle onto said weft as said weft is advanced along a path from said bobbin to said needle entrance portion of said water nozzle, said means for interrupting dispersion being mounted on a water-injection side of said water nozzle;

air suction means for sucking said fluffs from said weft positioned between said storage area and said needle entrance portion of said water nozzle and along at least a portion of a path of said weft extending from said bobbin to said needle entrance portion; and means for loosening said weft so that it contacts said fluffs on a surface of said tube wall of said needle entrance portion of said water nozzle.

* * * * *

UNITED STATES PATENT AND TRADEMARK OFFICE

CERTIFICATE OF CORRECTION

PATENT NO. : 5,529,094

DATED : June 25, 1996

INVENTOR(S) : Akira Nishimura, Kiyoshi Homma and Seishirou Ichikawa

It is certified that error appears in the above-indentified patent and that said Letters Patent is hereby corrected as shown below:

In Column 1, line 21, please change "application" to --applications--;
line 23, please delete "essentially" and change "Besides." to --Besides,--; and
line 30, please change "weave From" to --weave. From--.

In Column 3, line 9, please change "wall-during" to --wall during--.

In Column 5, line 15, please change "vinyl on" to --vinylon--.

In Column 6, line 33, please change "being." to --being pressurized.--.

In Column 7, line 9, please change "roller,abrasion" to --roller, abrasion--.

In Column 8, line 38, after "is" please insert --performed on needle entrance-- and change "during" to --and while--; and
line 48, please delete "of", first occurrence.

In Column 11, line 29, please delete "used".

In Column 12, line 21, please change "as durable" to --as a durable--.

UNITED STATES PATENT AND TRADEMARK OFFICE

CERTIFICATE OF CORRECTION

PATENT NO. : 5,529,094

DATED : June 25, 1996

INVENTOR(S) : Akira Nishimura, Kiyoshi Homma and Seishirou Ichikawa

It is certified that error appears in the above-indentified patent and that said Letters Patent is hereby corrected as shown below:

In Column 15, line 26, please delete "using a".

In Column 16, line 2, please change "said;" to --said nozzle;--.

Signed and Sealed this

Tenth Day of September, 1996

*Attest:*

*Attesting Officer*

BRUCE LEHMAN

*Commissioner of Patents and Trademarks*